US005857841A

United States Patent [19]

Kobayashi et al.

[11] Patent Number: 5,857,841

[45] **Date of Patent: *Jan. 12, 1999**

[54] FULL-CIRCUMFERENTIAL FLOW PUMP

[75] Inventors: Makoto Kobayashi; Masakazu Yamamoto; Yoshio Miyake; Koji Isemoto; Keita Uwai; Yoshiaki Miyazaki, all of Fujisawa, Japan

[73] Assignee: Ebara Corporation, Tokyo, Japan

[ * ] Notice: The term of this patent shall not extend beyond the expiration date of Pat. No. 5,616,013.

[21] Appl. No.: 578,897

[22] Filed: Dec. 27, 1995

[30] Foreign Application Priority Data

Dec. 27, 1994 [JP] Japan ..... 6-337848

[51] Int. Cl.[6] ..... F04B 17/00

[52] U.S. Cl. ..... 417/350; 417/423.5; 417/423.8; 417/423.14

[58] Field of Search ..... 417/350, 423.5, 417/423.8, 423.14

[56] References Cited

U.S. PATENT DOCUMENTS

| | | | |
|---|---|---|---|
| 2,814,254 | 11/1957 | Litzenberg . | |
| 2,915,978 | 12/1959 | Schaefer . | |
| 3,195,468 | 7/1965 | Bood . | |
| 3,410,218 | 11/1968 | Fivel . | |
| 4,978,281 | 12/1990 | Conger, III | 417/417.14 |
| 5,388,971 | 2/1995 | Kobayashi et al. . | |
| 5,478,215 | 12/1995 | Kobayashi et al. . | |
| 5,494,418 | 2/1996 | Moriya et al. | 417/423.14 |
| 5,610,134 | 3/1997 | Kobayashi et al. | 417/423.14 |

FOREIGN PATENT DOCUMENTS

| | | |
|---|---|---|
| 0 566 087 | 10/1993 | European Pat. Off. . |
| 0 566 089 | 10/1993 | European Pat. Off. . |
| 813 301 | 2/1937 | France . |
| 1 209 960 | 4/1958 | France . |
| 1653692 | 6/1971 | Germany . |
| 38 20 005 | 10/1989 | Germany . |
| 6-213192 | 8/1994 | Japan . |
| 2007 770 B | 5/1979 | United Kingdom . |

*Primary Examiner*—Bibhu Mohanty
*Attorney, Agent, or Firm*—Oblon, Spivak, McClelland, Maier & Neustadt, P.C.

[57] ABSTRACT

A full-circumferential flow pump includes an outer cylinder and a motor housed in the outer cylinder. The motor has a motor frame, a stator disposed in the motor frame, a main shaft, a rotor mounted on the main shaft and rotatably disposed in the stator. The outer cylinder defines an annular space defined around the motor frame, the outer cylinder having a pump suction port defined therein for introducing a fluid therethrough into the annular space. A pump unit is mounted on an end of the main shaft, and the outer cylinder has a discharge window defined therein for discharging a fluid from the pump unit. A discharge case is mounted on an outer circumferential surface of the outer cylinder in communication with the discharge window, the discharge case having a pump discharge port.

22 Claims, 8 Drawing Sheets

FULL-CIRCUMFERENTIAL FLOW PUMP

BACKGROUND OF THE INVENTION

1. Field of the Invention

The present invention relates to a full-circumferential flow pump, and more particularly to a full-circumferential flow pump having an impeller on an end of a shaft of a motor, with an annular space or flow passage defined around the motor.

2. Description of the Prior Art

German laid-open patent publication No. 1,653,692 (DE 1,653,692) discloses a pump in which a fluid being handled flows around a motor. The disclosed pump allows its main shaft to be rotated manually and also allows pump units to be inspected and serviced for maintenance without the need for removing pipes connected to the pump.

FIG. 9 of the accompanying drawings shows the disclosed pump. As shown in FIG. 9, the pump has a block-like main body 100, a motor stator 101 housed therein, and a motor rotor 102 disposed in the motor stator 101 with a small clearance between the motor stator 101 and the motor rotor 102. Impellers 103, 104 are fixedly mounted on respective opposite ends of the motor rotor 102. A fluid flows from a pump suction port 105 into the block body 101, is divided into two lateral flows which are then pressurized by the impellers 103, 104. The impellers 103, 104 discharge the respective fluid flows, which are then merged and discharged from the main body 101 through a discharge port 106.

The disclosed pump shown in FIG. 4 is highly likely to suffer problems which arise due to pressure irregularities applied to the motor stator 101. More specifically, the pump has three different regions around the motor which include:

1) a region in which the fluid under a suction pressure flows;

2) a region in which the fluid under a discharge pressure flows; and 3) a region in which no fluid flows at all.

On account of these different regions, the pressure (external force) imposed on the motor stator 101 is not uniform, tending to strain or deform the motor stator 101.

Furthermore, since the discharge pressure is applied to the motor, especially its rotor chambers, the pump is not suitable for use in applications under high discharge pressure. The pump may possibly be open to difficulties when it is incorporated in a unit pump system in which pumps are series-connected to produce a high pump head.

The pump is highly liable to suffer drawbacks when an outer motor frame is made of thin sheet metal and also the pump discharge pressure is high. When subjected to external forces such as loads from the piping, the motor of the disclosed pump tends to cause trouble because the outer motor frame and an outer cylinder of the pump are integrally formed with each other.

SUMMARY OF THE INVENTION

It is therefore an object of the present invention to provide a full-circumferential flow pump which is arranged to uniformize external forces (external pressure) applied to an outer motor frame surrounding a motor stator to prevent the outer motor frame from being strained or deformed, and which prevents a pump discharge pressure from being applied to a motor including rotor chambers so as to make the pump suitable for developing a high discharge pressure.

Another object of the present invention is to provide a full-circumferential flow pump which allows internal mechanisms to be inspected and serviced for maintenance without the need for removal of pipes connected to the pump.

To achieve the above object, there is provided in accordance with the present invention a full-circumferential flow pump comprising: an outer cylinder; a motor housed in the outer cylinder, the motor having a motor frame, a stator disposed in the motor frame, a main shaft, a rotor mounted on the main shaft and rotatably disposed in the stator, the outer cylinder defining an annular space defined around the motor frame, the outer cylinder having a pump suction port defined therein for introducing a fluid therethrough into the annular space and a discharge window defined therein for discharging a fluid therethrough; a pump unit having an impeller mounted on an end of the main shaft for pumping a fluid; and a discharge case mounted on an outer circumferential surface of the outer cylinder and having a discharge port for discharging a pumped fluid therethrough and through the discharge window.

A fluid drawn in through the pump suction port is introduced through the annular space into the pump unit. The fluid pressurized and discharged by the pump unit flows through the discharge window into the discharge case, from which the fluid is discharged through the pump discharge port out of the pump. The cylindrical motor frame is fully circumferentially surrounded by the fluid that is drawn into the pump. Therefore, the cylindrical motor frame is subject to a uniform pressure and will not be strained or deformed irregularly.

Inasmuch as only the pressure under which the fluid is drawn into the pump is applied to the outer cylinder, the motor frame, and a rotor chamber in the motor, the full-circumferential flow pump is suitable especially for use in applications under high discharge pressures. If the motor comprises a canned motor, then the pressure resistance of the motor depends on the wall thickness of the can of the canned motor. However, the wall thickness of the can cannot substantially be increased due to limitations imposed by the electric characteristics of the canned motor. For this reason, the structure of the full-circumferential flow pump according to the present invention is effective particularly if the motor used is a canned motor. The full-circumferential flow pump according to the present invention is also useful in applications where a plurality of pumps are series-connected in operation.

According to the present invention, there is also provided a full-circumferential-flow double-suction pump comprising: an outer cylinder; a motor housed in the outer cylinder, the motor having a motor frame, a stator disposed in the motor frame, a main shaft, a rotor mounted on the main shaft and rotatably disposed in the stator, the outer cylinder defining an annular space defined around the motor frame, the outer cylinder having a pump suction port defined therein for introducing a fluid therethrough into the annular space and a pair of discharge windows defined therein for discharging a fluid therethrough; a pair of pump units mounted on respective opposite ends of the main shaft for pumping a fluid, the pump unit having an impeller; and a discharge case mounted on an outer circumferential surface of the outer cylinder and having a pump discharge port for discharging a pumped fluid therethrough and through the discharge windows.

The above and other objects, features, and advantages of the present invention will become apparent from the following description when taken in conjunction with the accompanying drawings which illustrate preferred embodiments of the present invention by way of example.

DETAILED DESCRIPTION OF THE PREFERRED EMBODIMENTS

Figure 1:
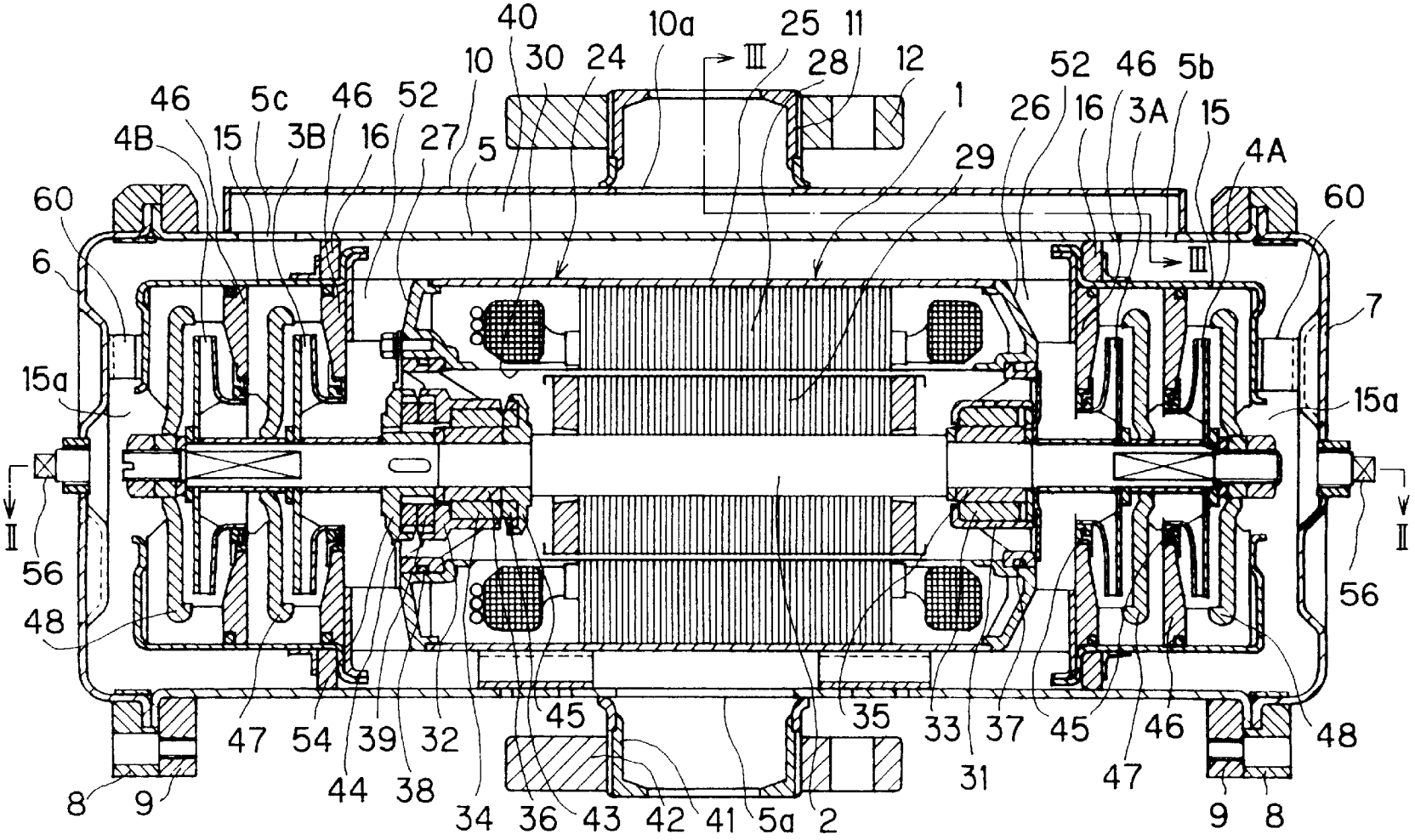
FIG. 1 is a cross-sectional view of a full-circumferential flow pump according to a first embodiment of the present invention.
Figure 2:
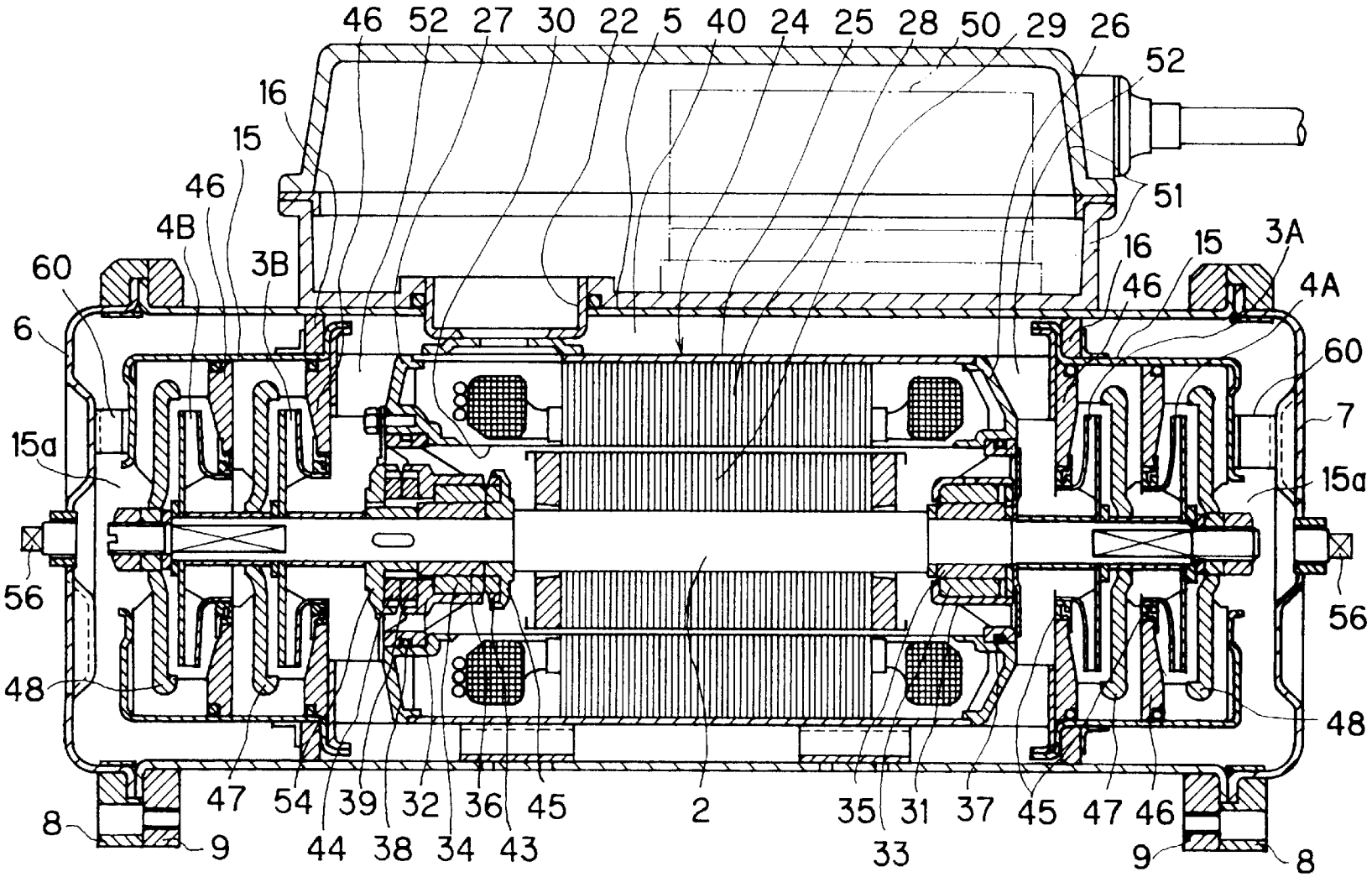
FIG. 2 is a cross-sectional view taken along line II—II of FIG. 1.

As shown in FIGS. 1 and 2, a full-circumferential flow pump according to a first embodiment of the present invention is of the double-suction type and has a canned motor 1 disposed centrally therein and pairs of impellers 3A, 4A and impellers 3B, 4B mounted respectively on opposite ends of a rotatable main shaft 2 of the canned motor 1, each of the impellers having a suction port opening axially inwardly. The pairs of impellers 3A, 4A and impellers 3B, 4B are part of respective pump units that are positioned axially one on each side of the canned motor 1. These pump units have the same shut-off head but different flow rates. The canned motor 1 and the impellers 3A, 4A and 3B, 4B are housed in an outer cylinder 5 and a pair of end covers 6, 7. The end covers 6, 7 are removably joined respectively to opposite ends of the outer cylinder 5 by flanges 8, 9. The impellers 3A, 4A and 3B, 4B are composed of vanes made of sheet metal.

Figure 3:
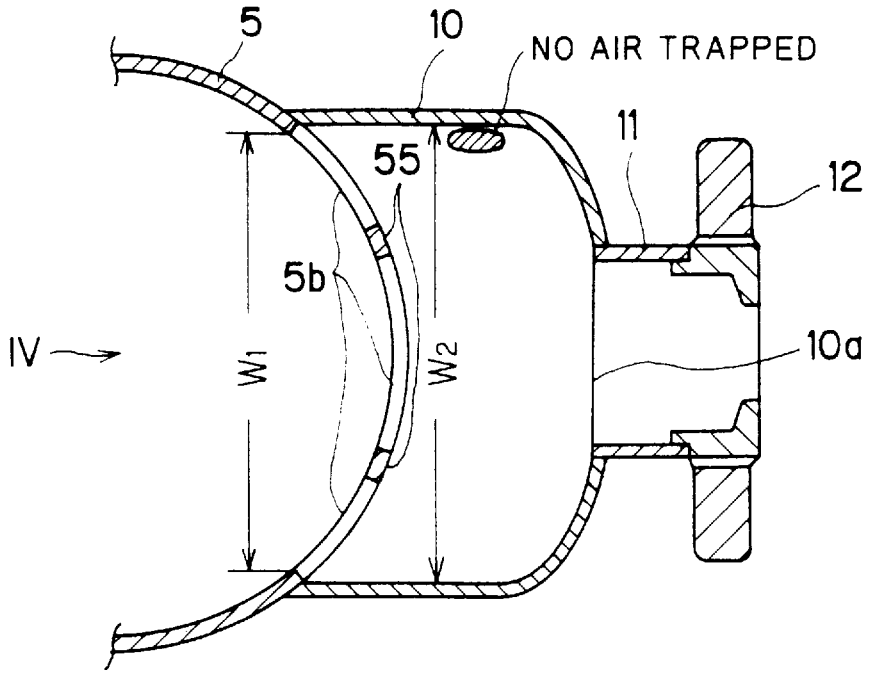
FIG. 3 is a cross-sectional view taken along line III—III of FIG. 1.

As shown in FIG. 1, the outer cylinder 5 has a pump suction port 5*a* defined centrally in its circumferential wall and axially spaced discharge windows 5*b*, 5*c* defined in its circumferential wall near the respective opposite ends thereof in diametrically opposite relationship to the pump suction port 5*a*. A suction nozzle 41 is fixed to the outer circumferential surface of the outer cylinder 5 over the pump suction port 5*a*, with a suction flange 42 secured to the suction nozzle 41. A discharge case 10 is mounted on the outer circumferential surface of the outer cylinder 5 over the discharge windows 5*b*, 5*c*, thus interconnecting the discharge windows 5*b*, 5*c*. The discharge case 10 has a pump discharge port 10*a* opening centrally therein in diametrically opposite relationship to the suction pot 5*a*. As shown in FIG. 3, the discharge windows 5*b*, 5*c* defined in the outer cylinder 5 have a circumferential width $W_1$ which is the same as the width $W_2$ of the discharge case 10, so that no air will be trapped in the discharge case 10. A discharge nozzle 11 is secured to the outer surface of the discharge case 10 in registry with the pump discharge port 10*a*. A discharge flange 12 is secured to the discharge nozzle 11.

The outer cylinder 5 houses therein axially spaced partition walls 15 which accommodate the respective pairs of impellers 3A, 4A and 3B, 4B. The partition walls 15, each of which is substantially in the form of a cylindrical container, carry resilient seal members 16 such as of rubber fixedly mounted on respective open ends thereof, and have respective discharge openings 15*a* defined in closed ends or bottoms thereof. The resilient seal members 16 are held against the inner circumferential surface of the outer cylinder 5 for preventing a fluid discharged by the pump units from leaking back toward the pump suction port 5*a*.

Figure 4:
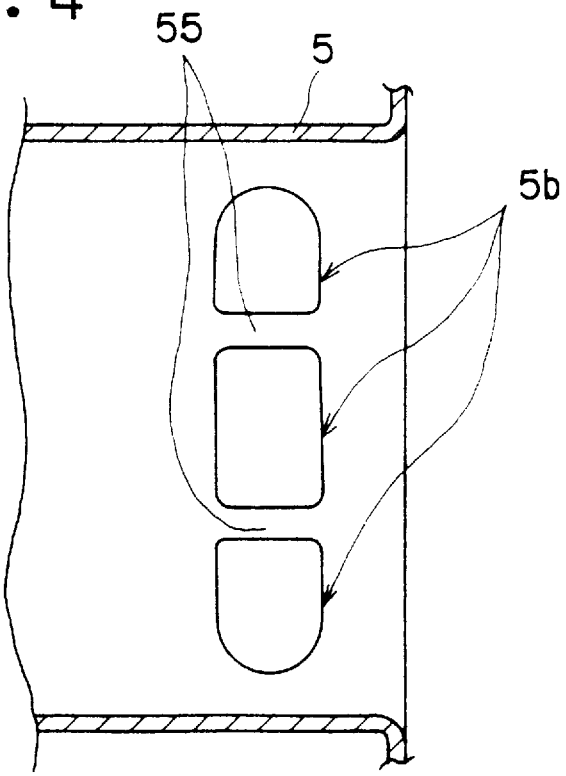
FIG. 4 is a view as viewed in the direction indicated by the arrow IV in FIG. 3.

As shown in FIG. 4, the discharge windows 5*b*, 5*c* (only the discharge windows 5*b* are shown) defined in the outer cylinder 5 have a plurality of bars 55 axially extending thereacross. The bars 55 allow the partition walls 15 with the seal members 16 carried thereon to be easily inserted into a position in the outer cylinder 5 beyond the discharge windows 5*b*, 5*c*.

Figure 5:
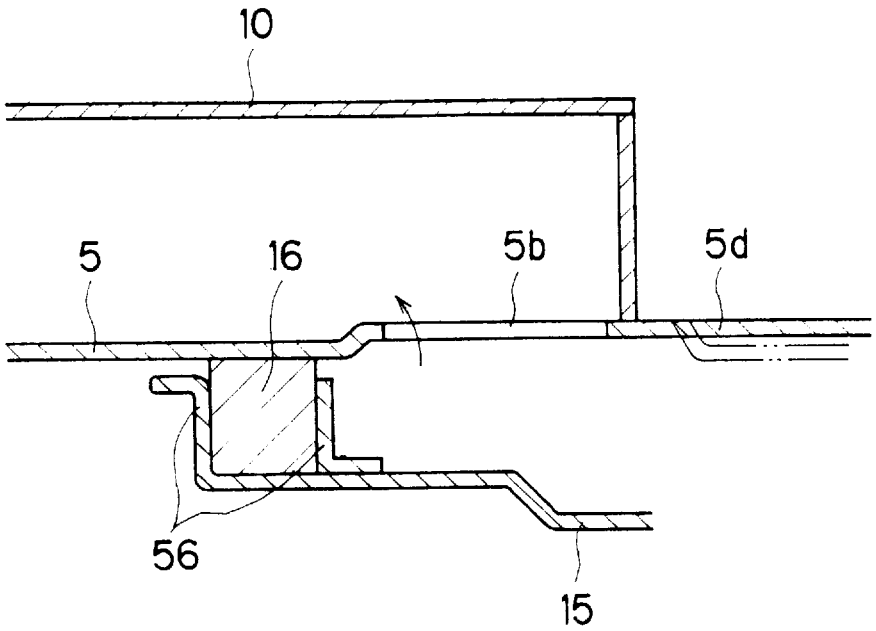
FIG. 5 is an enlarged cross-sectional view of a discharge window, a seal member, and their surrounding regions shown in FIG. 1.

As shown in FIG. 5, the partition walls 15 (only one of them are shown) have stoppers 56 on their open ends which extend radially outwardly in sandwiching relationship to the seal members 16 for thereby retaining the seal members 16 from being accidentally dislodged. The outer cylinder 5 has enlarged cylinder portions 5*d* disposed on discharge sides of the pump units and slightly projecting radially outwardly. The enlarged cylinder portions 5*d* are also effective to insert the partition walls 15 with the seal members 16 carried thereon easily into the outer cylinder 5 beyond the discharge windows 5*b*, 5*c*. Furthermore, the enlarged cylinder portions 5*d* serve to prevent the discharge windows 5*b*, 5*c* from being deformed in the direction indicated by the arrow due to the difference between pressures inside and outside of the outer cylinder 5. The enlarged cylinder portions 5*d* are also effective in keeping the outer cylinder 5 cylindrical in shape and mechanically strong at a desired level.

As shown in FIG. 1, the partitions 15 house therein respective pairs of axially spaced holders 46 which hold respective liner rings 45, respective return guide vanes 47 positioned between the holders 46 for guiding a fluid discharged from the impellers 3A, 3B toward the impellers 4A, 4B, and respective return guide vanes 48 positioned axially outwardly of the impellers 4A, 4B for guiding the fluid discharged from the impellers 4A, 4B to flow radially inwardly.

An annular space or flow passage 40 is defined between the outer cylinder 5 and a motor frame 24 of the canned motor 1. The motor frame 24 comprises a substantially cylindrical outer frame 25 and a pair of side frame plates 26, 27 connected respectively to open ends of the outer frame 25. A cable housing 22 (see FIG. 2) is welded to the outer frame 25 and partly projects radially outwardly through the outer cylinder 5. Leads (not shown) extend from motor coils disposed in the outer frame 25, pass through the cable housing 22, and are connected to secondary terminals (not shown) of a frequency converter 50 which is housed in a case 51 mounted on the outer circumferential surface of the outer cylinder 5. The frequency converter 50 has primary terminals (not shown) connected to power supply cables.

The canned motor 1 comprises a stator 28 and a rotor 29 which are disposed in the motor frame 24. The rotor 29 is supported on the main shaft 2 and positioned radially inwardly of a cylindrical can 30 that is fitted in the stator 28. Fluid guides 52 having radial flow passages are mounted respectively on the side frame plates 26, 27 and positioned axially between the side frame plates 26, 27 and the holders 46. The open ends of the partition walls 15 are held by the fluid guides 52.

Bearing housings 31, 32 are detachably mounted in the respective side frame plates 26, 27. The bearing housings 31, 32 hold radial bearings 33, 34 respectively therein. A shaft sleeve 35 fitted over the main shaft 2 is rotatably supported by the radial bearing 33, and a shaft sleeve 36 fitted over the main shaft 2 is rotatably supported by the radial bearing 34. The bearing housings 31, 32 and the side frame plates 26, 27 are fixed to each other by bearing housing ends clearance-fitted in sockets in the side frame plates 26, 27 and resilient O-rings 37, 38 disposed in the bearing housing ends.

The bearing housing 32 also holds a stationary thrust bearing 39. The radial bearing 34 has an end face doubling as a stationary thrust sliding member. A rotatable thrust bearing 43 as a rotatable thrust sliding member and a rotatable thrust bearing 44 are positioned one on each side of the radial bearing 34 and the stationary thrust bearing 39. The rotatable thrust bearing 43 is fixed to a thrust disk 45 mounted on the main shaft 2, and the rotatable thrust bearing 44 is fixed to a thrust disk 54 mounted on the main shaft 2.

Figure 6A:
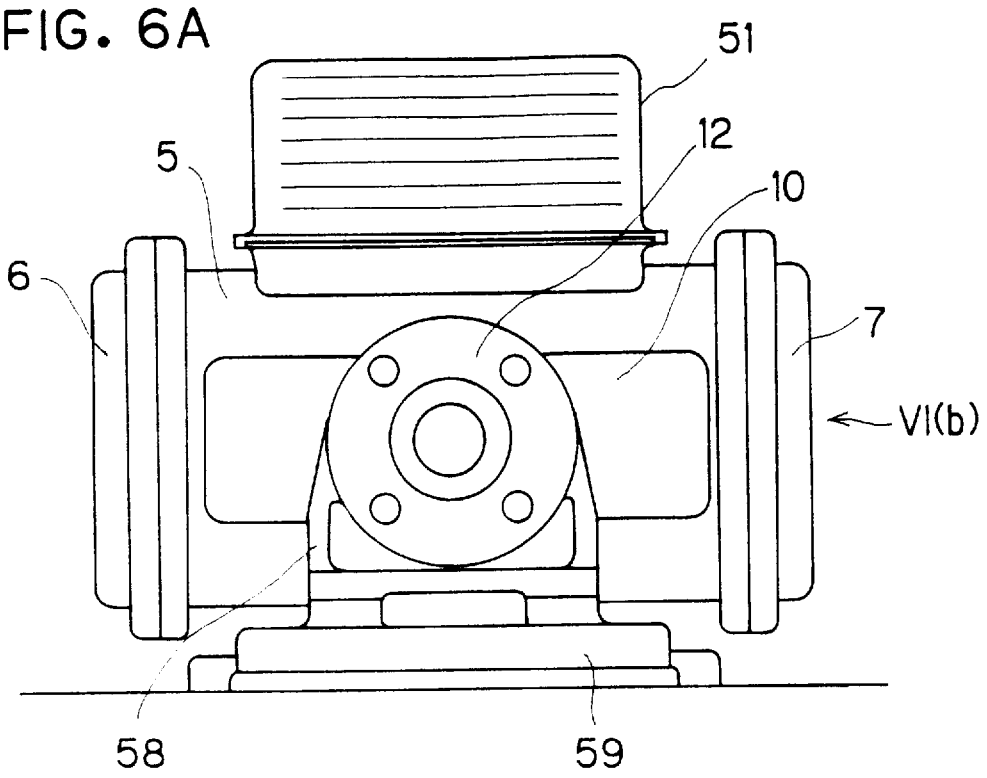
FIG. 6A is a front elevational view of the full-circumferential flow pump shown in FIG. 1.
Figure 6B:
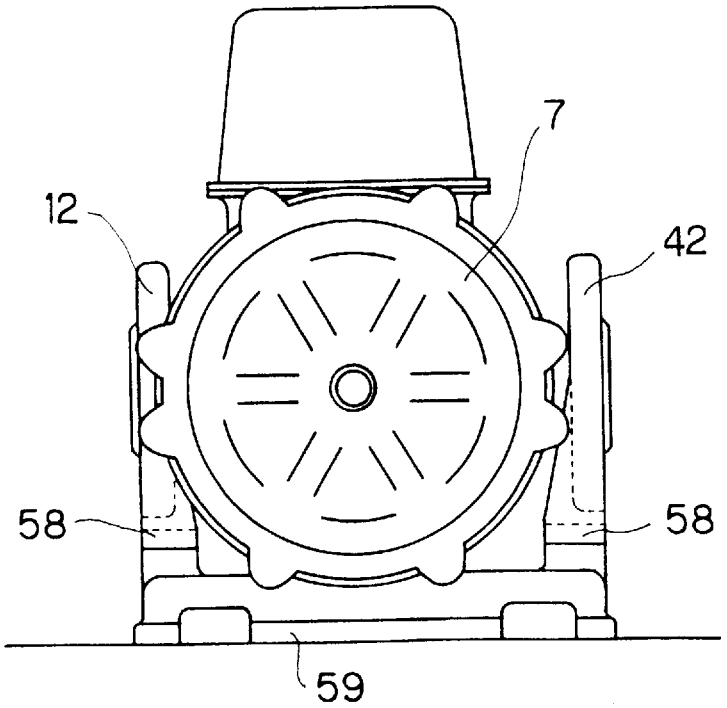
FIG. 6B is a side elevational view of the full-circumferential flow pump shown in FIG. 1, as viewed in the direction indicated by the arrow VI(b)

FIGS. 6A and 6B show the full-circumferential flow pump according to the first embodiment respectively in front elevation and side elevation. As shown in FIGS. 6A and 6B, the full-circumferential flow pump has the pump suction port 5*a* and the discharge port 10*a* positioned at its opposite sides. Legs 58 are fixed respectively to the suction and discharge flanges 12, 42, and extend downwardly. The lower ends of the legs 58 are fixedly connected to a base 59 which is placed on a floor.

Operation of the full-circumferential flow pump according to the first embodiment will be described below.

A fluid drawn in from the pump suction port 5*a* is divided into two flows in the annular flow passage 40, and the fluid flows are introduced through the respective fluid guides 52 into the impellers 3A, 3B. The fluid flows are then discharged from the impellers 3A, 3B, and introduced through the respective guide vanes 47 into the impellers 4A, 4B. After pressurized by the impellers 4A, 4B, the fluid flows are guided by the return guide vanes 48 and then discharged from the respective discharge openings 15*a* of the partition walls 15. The fluid flows discharged from the discharge openings 15*a* pass through the respective discharge windows 5*b*, 5*c* in the outer cylinder 2 into the discharge case 10 where the fluid flows are merged with each other. The fluid in the discharge case 10 is thereafter discharged from the pump discharge port 10*a* and the discharge nozzle 11.

With the arrangement of the first embodiment, the outer frame 25 of the motor frame 24 is fully circumferentially surrounded by the fluid that is drawn into the pump. Therefore, the outer frame 25 is subject to a uniform pressure and will not be strained or deformed irregularly. The partition walls 15 held against the inner circumferential surface of the outer cylinder 5 separate the interior space of the outer cylinder 5 into a suction pressure region on the suction side of the pump units and a discharge pressure region on the discharge side of the pump units, thus uniformizing a pressure distribution both radially and circumferentially in the outer cylinder 5. Since only a suction pressure, i.e., the pressure under which the fluid is drawn into the pump, is exerted in rotor chambers defined axially one on each side of the rotor 29, the pump can be used in applications under high discharge pressures.

The partitions 15 are supported on the end covers 6, 7 by respective stays 60. Since the stays 60 are required only when the pump is assembled and the partitions 15 are pressed toward the motor 1 under the discharge pressure while the pump is in operation, it is not necessary to fasten the stays 60 with bolts or other special fastening members.

Inasmuch as the resilient seal members 16 such as of rubber are interposed between the inner circumferential surface of the outer cylinder 5 and the outer circumferential surfaces of the partition walls 15, the partition walls 15 can be detachably mounted in the outer cylinder 5, and the interior space of the outer cylinder 5 is reliably separated into the suction pressure region and the discharge pressure region.

Furthermore, the end covers 6, 7 removably mounted on the respective opposite ends of the outer cylinder 5 allow the internal mechanisms of the pump to be inspected and serviced for maintenance without the need for detaching pipes connected to the pump. The pump with the canned motor 1 incorporated as shown has sliding parts such as the bearings, the liner rings, etc. that are to be mainly inspected and serviced for maintenance. The structure according to the first embodiment makes it possible to remove sliding or rotating parts, bearings, and other internal mechanisms from the canned motor 1 and the outer cylinder 5 without the need for removing the pipes, once the end covers 6, 7 are detached from the outer cylinder 5.

Since the full-circumferential flow pump is of the double-suction type, it can handle the fluid with the two pump units and has a specific speed of $Ns=\frac{1}{2}^{1/2}$. The impellers are composed of substantially two-dimensional blades which can be pressed to shape with ease. It is known that as the speed of the fluid at the suction ports of the impellers increases, the suction capability of the pump is lowered when the pump operates at a suction condition. However, the pump according to this embodiment is advantageous with respect to the problem of such a reduced suction capability because the double-suction pump can handle the fluid with the two pump units.

The fluid being handled by the pump can flow into and out of the rotor chambers. Since the canned motor is cooled by the fluid, therefore, the canned motor may be reduced in size. The rotor chambers and the pump units are not required to be sealed in a fluid-tight manner. Inasmuch as axial thrust forces produced on the shaft by the pump units are balanced in the double-suction pump, the load capacity of the bearings can be reduced. The balanced thrust forces produced on the shaft permit the bearing housings 31, 32 and the motor frame 24 to be fixed together through a simple structure which is composed of the bearing housing ends clearance-fitted in sockets in the side frame plates 26, 27 and resilient O-rings 37, 38 disposed in the bearing housing ends. This structure allows the bearings to be self-centered, and does not require surrounded parts to be machined with high accuracy.

The double-suction pump according to this embodiment is highly advantageous for use at high rotational speeds of 4000 rpm or more from the standpoints of hydraulic design considerations and axial thrust loads.

Moreover, because a complete pressure balance is achieved between the rotor chambers, no slurry is drawn into the rotor chambers. Consequently, the pump is of a structure highly resistant to slurry.

In the first embodiment, the frequency converter 50 is fixedly mounted on the outer circumferential surface of the outer cylinder 5, and covered with the case 51. As the frequency converter 50 is secured to the outer cylinder 5 with which the fluid is held in contact, the frequency converter 50 is efficiently cooled by the outer cylinder 5. Highly integrated circuits such as those incorporated in the frequency converter 50 are generally susceptible to external stresses and vibrations. Therefore, the frequency converter 50 should be mounted on the outer circumferential surface of the outer cylinder 5, to which only the suction pressure is applied, for higher reliability, rather than being mounted in a region where the discharge pressure is applied.

In the first embodiment, moreover, plugs 56 are detachably mounted coaxially on the respective end covers 6, 7 which openably close the opposite open ends of the outer cylinder 5. The plugs 56 allow the rotatable parts to be confirmed for manual rotation without the need for detaching the end covers 6, 7. Specifically, after the plugs 56 are removed, a screwdriver bit is inserted in a slot in the ends of the main shaft 2. After it has been confirmed that the main shaft 2 can be manually rotated with the screwdriver bit, the plugs 56 may be installed again on the end covers 6, 7.

The pump units disposed axially one on each side of the canned motor 1 may be of designs capable of handling different flow rates. For example, if pump units having nominal flow rate ratios of 1 and 1.6 are combined, then it is possible to provide pumps capable of handling flow rates of 2 (1+1), 2.6 (1+1.6), and 3.2 (1.6+1.6).

The discharge case 10 prevents air from being trapped therein, and hence the pump is free from operation failures which would otherwise occur due to air traps. As no header pipe is required to connect the discharge windows 5*b*, 5*c*, the pump units can be inspected and serviced for maintenance without the need for removing the pipes.

If a multi-stage full-circumferential flow pump of the double-suction type is constructed according to the principles of the present invention, then outer circumferential flow paths are defined around the partition walls 15, and the discharge case 10 is disposed over the outer circumferential flow paths. This arrangement makes it possible to reduce the overall length of the multi-stage full-circumferential flow pump.

Figure 7:
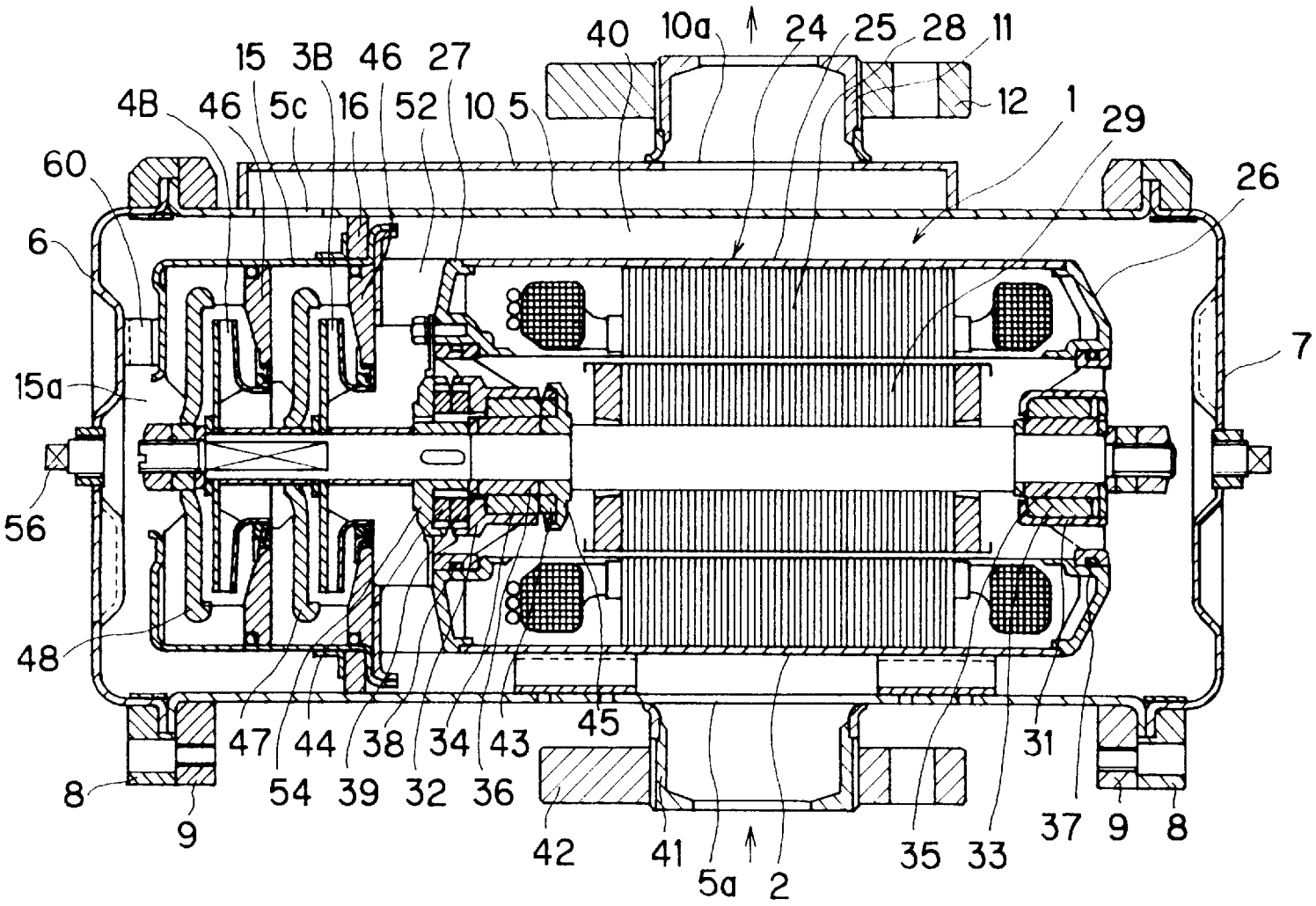
FIG. 7 is a cross-sectional view of a full-circumferential flow pump according to a second embodiment of the present invention.

FIG. 7 shows a full-circumferential flow pump according to a second embodiment of the present invention. Those parts shown in FIG. 7 which are structurally or functionally identical to those shown in FIGS. 1 and 2 are denoted by identical reference numerals, and will not be described in detail below.

As shown in FIG. 7, the full-circumferential flow pump according to the second embodiment is of the single-suction type and has a canned motor 1 disposed centrally therein and a pair of impellers 3B, 4B mounted on an end of a rotatable main shaft 2 of the canned motor 1, each of the impellers 3B, 4B having a suction port opening axially inwardly. No impellers are mounted on the other end of the main shaft 2, hence no partition wall is disposed in a corresponding end of the outer cylinder 5. Other structural details of the full-circumferential flow pump shown in FIG. 7 are essentially the same as those of the full-circumferential flow pump shown in FIGS. 1 and 2.

The full-circumferential flow pump of the single-suction type shown in FIG. 7 operates as follows:

A fluid drawn in from the pump suction port 5*a* is introduced into the annular flow passage 40, and then introduced from the annular flow passage 40 through the fluid guide 52 into the impellers 3B. The fluid is then discharged from the impeller 3B, and introduced through the guide vane 47 into the impeller 4B. After pressurized by the impeller 4B, the fluid is guided by the return guide vane 48 and then discharged from the discharge opening 15*a* of the partition wall 15. The fluid discharged from the discharge opening 15*a* passes through the discharge window 5*c* in the outer cylinder 2 into the discharge case 10. The fluid in the discharge case 10 is thereafter discharged from the pump discharge port 10*a* and the discharge nozzle 11. While the full-circumferential flow pump of the single-suction type according to the first embodiment does not offer those advantages which are peculiar to the full-circumferential flow pump of the double-suction type according to the first embodiment, other advantages offered by the full-circumferential flow pump of the single-suction type according to the second embodiment are the same as those of the full-circumferential flow pump of the double-suction type according to the first embodiment.

Figure 8:
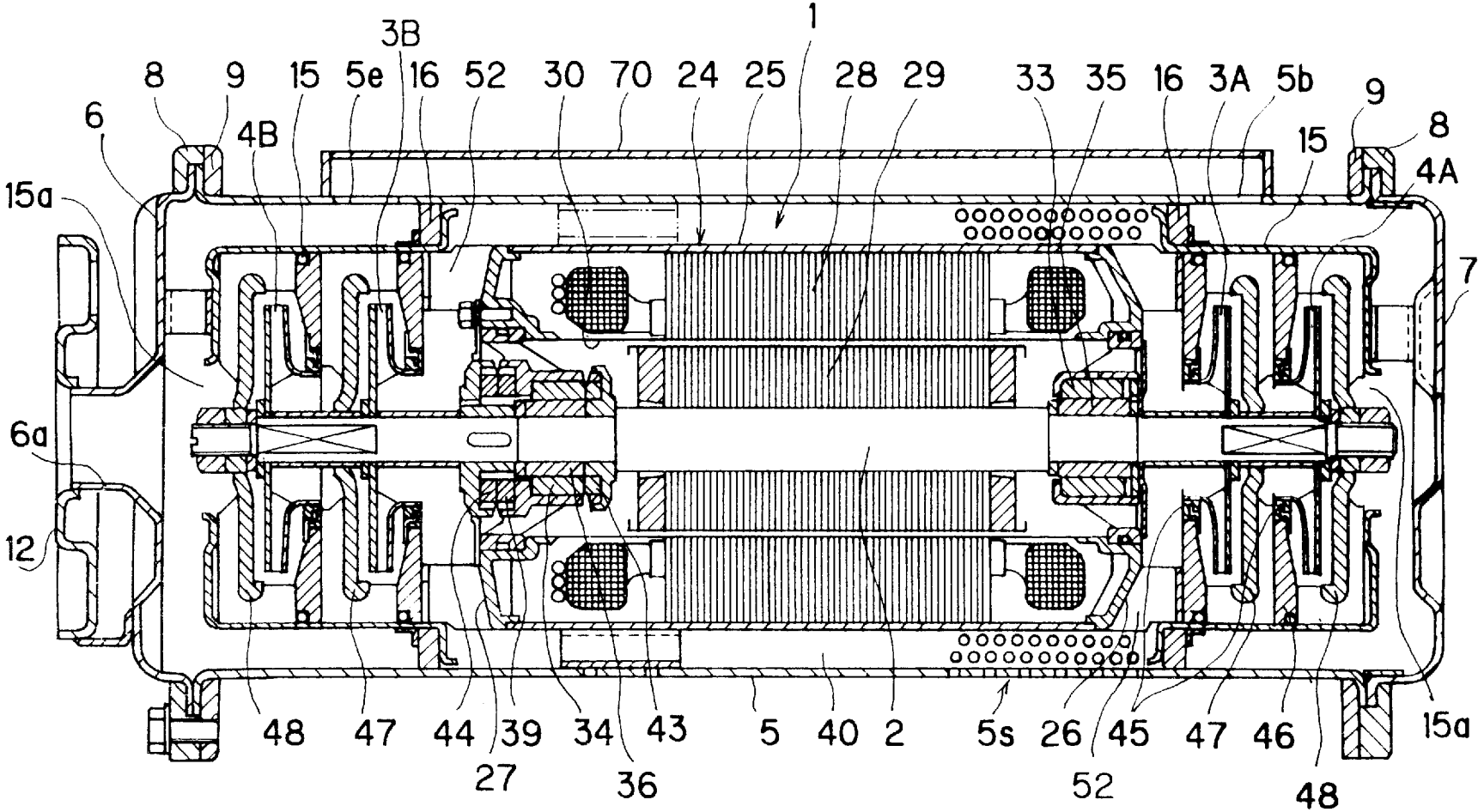
FIG. 8 is a cross-sectional view of a full-circumferential flow pump according to a third embodiment of the present invention.
Figure 9:
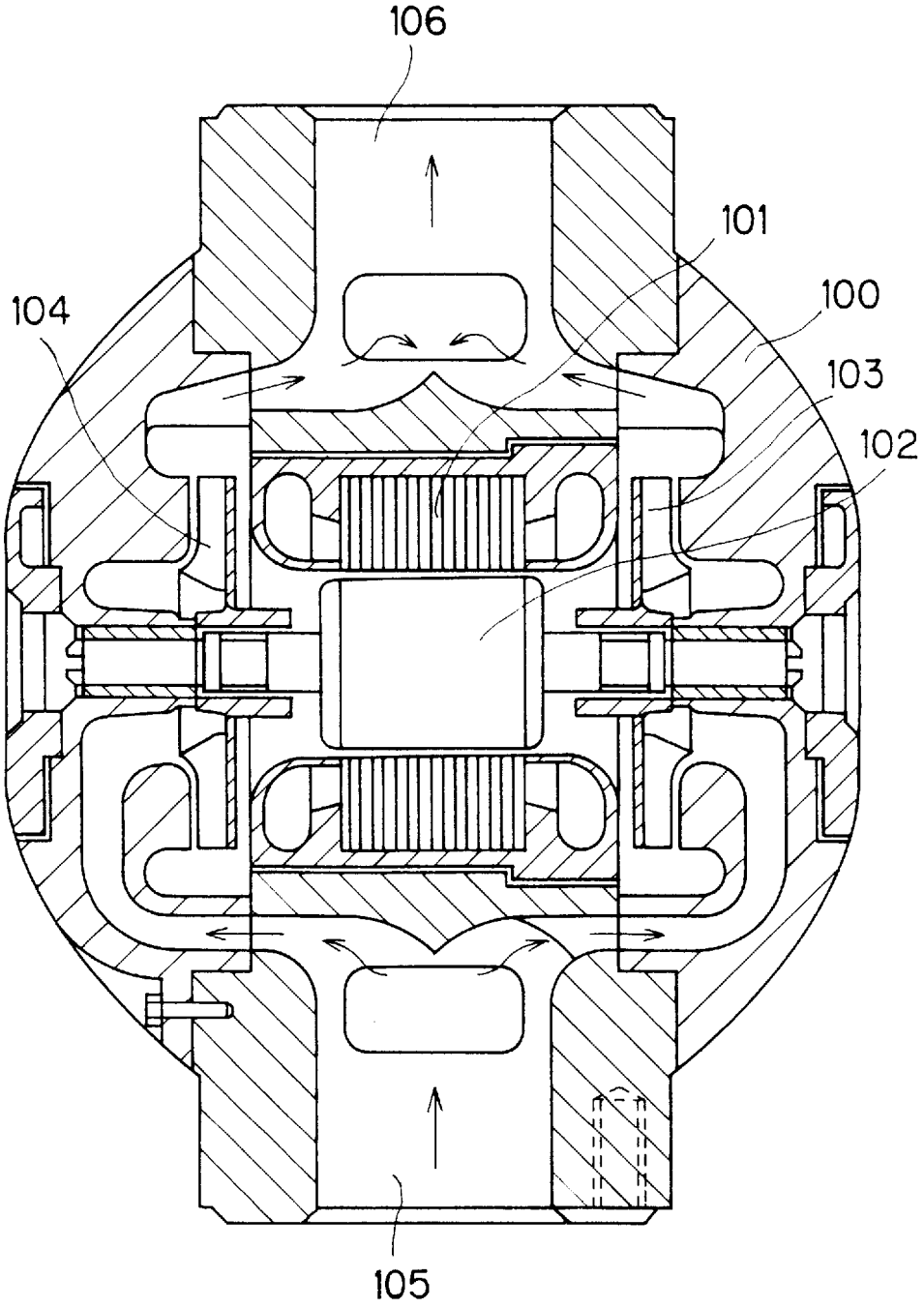
FIG. 9 is a cross-sectional view of a conventional pump.

FIG. 8 shows a full-circumferential flow pump according to a third embodiment of the present invention. Those parts shown in FIG. 8 which are structurally or functionally identical to those shown in FIGS. 1 and 2 are denoted by identical reference numerals, and will not be described in detail below.

As shown in FIG. 8, the full-circumferential flow pump according to the third embodiment, which is a submersible pump, has no pump suction port in the outer cylinder 5, but has a strainer 5*s* having a plurality of suction openings defined in the outer cylinder 5. The outer cylinder 5 has a discharge window 5*b* and a passage window 5*e* which are defined therein that are connected to each other by a collection pipe 70 mounted on the outer circumferential surface of the outer cylinder 5. An end cover 6 fixed to an end of the outer cylinder 5 by flanges 8, 9 has a discharge nozzle 6*a* with a discharge flange 12 fixed thereto. Other structural details of the full-circumferential flow pump shown in FIG. 8 are essentially the same as those of the full-circumferential flow pump shown in FIGS. 1 and 2.

The submersible full-circumferential flow pump of the single-suction type shown in FIG. 8 operates as follows:

A fluid drawn in from the strainer 5*s* is divided into two flows in the annular flow passage 40, and the fluid flows are introduced through the respective fluid guides 52 into the impellers 3A, 3B. The fluid flows are then discharged from the impellers 3A, 3B, and introduced through the respective guide vanes 47 into the impellers 4A, 4B. After pressurized by the impellers 4A, 4B, the fluid flows are guided by the return guide vanes 48 and then discharged from the respective discharge openings 15*a* of the partition walls 15. The fluid flow discharged from one of the discharge openings 15*a* is discharged out of the pump through the discharge nozzle 6*a* of the end cover 6, and the fluid flow discharged through the other discharge opening 15*a* passes through the discharge window 5*b* into the collection tube 70. Then, the fluid flow flows through the passage window 5*e* into a space surrounded by an end of the outer cylinder 5, the end cover 6, and the corresponding partition wall 15, and thereafter is discharged out of the pump through the discharge nozzle 6*a* of the end cover 6.

Since the outer cylinder 5, the outer frame 25, and the rotor chambers are subject to only the water pressure at the depth to which the pump is submerged in water, the submersible pump according to the third embodiment is useful in applications under high discharge pressures. Other advantages offered by the submersible full-circumferential flow pump of the double-suction type according to the third embodiment are the same as those of the full-circumferential flow pump of the double-suction type according to the first embodiment.

Although certain preferred embodiments of the present invention have been shown and described in detail, it should be understood that various changes and modifications may be made therein without departing from the scope of the appended claims.

What is claimed is:

1. A full-circumferential flow pump comprising:

an outer cylinder;

a motor housed in said outer cylinder, said motor having a motor frame, a stator disposed in said motor frame, a main shaft, a rotor mounted on said main shaft and rotatably disposed in said stator, said outer cylinder defining an annular space defined around said motor frame, said outer cylinder having a suction port defined therein for introducing a fluid therethrough into said annular space and a discharge window defined therein for discharging a fluid therethrough;

a pump unit having an impeller mounted on an end of said main shaft for pumping a fluid; and a discharge case mounted on an outer circumferential surface of said outer cylinder and having a discharge port for discharging a pumped fluid therethrough and through said discharge window.

2. The full-circumferential flow pump according to claim 1, further comprising a partition wall disposed in said outer cylinder and housing said pump unit, said partition wall separating an interior space of said outer cylinder into a suction pressure region and a discharge pressure region.

3. The full-circumferential flow pump according to claim 2, further comprising a resilient seal member interposed between an inner circumferential surface of said outer cylinder and said partition wall.

4. The full-circumferential flow pump according to claim 3, wherein said partition wall has a portion for retaining said resilient seal member against dislodgment from the partition wall.

5. The full-circumferential flow pump according to claim 3 or 4, wherein said outer cylinder includes a bar extending axially across said discharge window.

6. The full-circumferential flow pump according to claim 3 or 4, wherein said outer cylinder includes an enlarged cylinder portion in said discharge pressure region.

7. The full-circumferential flow pump according to claim 1, wherein said discharge window has a circumferential width substantially equal to a width of said discharge case so that air is not be trapped in said discharge case.

8. The full-circumferential flow pump according to claim 1, further comprising a pair of end covers removably mounted on respective opposite ends of said outer cylinder.

9. The full-circumferential flow pump according to claim 8, further comprising a plug removably mounted on said end cover for confirming manual rotation of said main shaft.

10. The full-circumferential flow pump according to claim 1, further comprising a frequency converter mounted on an outer circumferential surface of said outer cylinder.

11. A full-circumferential-flow double-suction pump comprising:

an outer cylinder;

a motor housed in said outer cylinder, said motor having a motor frame, a stator disposed in said motor frame, a main shaft, a rotor mounted on said main shaft and rotatably disposed in said stator, said outer cylinder defining an annular space defined around said motor frame, said outer cylinder having a suction port defined therein for introducing a fluid therethrough into said annular space and a pair of discharge windows defined therein for discharging a fluid therethrough;

a pair of pump units mounted on respective opposite ends of said main shaft for pumping a fluid, said pump unit having an impeller; and a discharge case mounted on an outer circumferential surface of said outer cylinder and having a discharge port for discharging a pumped fluid therethrough and through said discharge windows.

12. The full-circumferential-flow double-suction pump according to claim 11, further comprising a pair of partition walls disposed in said outer cylinder and housing said pump units, respectively, said partition walls separating an interior space of the outer cylinder into a suction pressure region and a discharge pressure region.

13. The full-circumferential-flow double-suction pump according to claim 11 or 12, further comprising a pair of end covers removably mounted on respective opposite ends of said outer cylinder.

14. The full-circumferential-flow double-suction pump according to claim 11, wherein each of said discharge windows has a circumferential width substantially equal to a width of said discharge case so that air is not trapped in said discharge case.

15. The full-circumferential-flow double-suction pump according to claim 11, wherein said motor comprises a canned motor, and has a bearing housing supporting a bearing by which said main shaft is rotatably supported, said bearing housing and said motor frame being fixed to each other by a clearance-fit with a resilient O-ring disposed therebetween.

16. The full-circumferential-flow double-suction pump according to claim 11, wherein said motor is rotatable at a speed of not less than 4000 rpm.

17. The full-circumferential-flow double-suction pump according to claim 11, wherein said impeller has blades made of sheet metal.

18. The full-circumferential-flow double-suction pump according to claim 11, wherein said pump units have the same shut-off head but different flow rates.

19. A full-circumferential flow pump comprising:

an outer cylinder;

a motor housed in said outer cylinder, said motor having a motor frame, a stator disposed in said motor frame, a main shaft, a rotor mounted on said main shaft and rotatably disposed in said stator, said outer cylinder defining an annular space defining a flow passage around said motor frame, said outer cylinder having a pump suction port defined therein for introducing a fluid therethrough into said annular space;

a pump unit having an impeller mounted on an end of said main shaft; and a discharging port communicating with said pump unit independent of said annular space.

20. A full-circumferential flow double-suction pump comprising:

an outer cylinder;

a motor housed in said outer cylinder, said motor having a motor frame, a stator disposed in said motor frame, a main shaft, a rotor mounted on said main shaft and rotatably disposed in said stator, said outer cylinder defining an annular space defined around said motor frame, said outer cylinder having a pump suction port defined therein for introducing a fluid therethrough into said annular space;

a pair of pump units mounted on respective opposite ends of said main shaft, each of said pump units having an impeller; and a discharging port communicating with said pump units independent of said annular space.

21. A submersible double-suction pump comprising:

an outer cylinder;

a motor housed in said outer cylinder, said motor having a motor frame, a stator disposed in said motor frame, a main shaft, a rotor mounted on said main shaft and rotatably disposed in said stator, said outer cylinder defining an annular space defined around said motor frame, said outer cylinder having a plurality of suction openings defined therein for introducing a fluid therethrough into said annular space;

a pair of pump units mounted on respective opposite ends of said main shaft, each of said pump units having an impeller; and a discharging port communicating with said pump units independent of said annular space.

22. The submersible double-suction pump according to claim 21, further comprising a collection pipe mounted on an outer circumferential surface of said outer cylinder for collecting the fluid pressurized by said impellers on the respective opposite ends of said main shaft.

* * * * *